US006512324B1

(12) United States Patent
Makita et al.

(10) Patent No.: US 6,512,324 B1
(45) Date of Patent: Jan. 28, 2003

(54) STRETCHED MASK FOR COLOR PICTURE TUBE

(75) Inventors: Akira Makita, Tokyo (JP); Yutaka Matsumoto, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 09/302,987

(22) Filed: Apr. 30, 1999

(30) Foreign Application Priority Data

Apr. 30, 1998 (JP) ..... 10-121327

(51) Int. Cl.[7] ..... H01J 29/07
(52) U.S. Cl. ..... 313/402; 445/47
(58) Field of Search ..... 313/402, 403, 313/404, 405, 407, 408; 445/47; 420/8, 9, 120

(56) References Cited

U.S. PATENT DOCUMENTS 4,751,424 A * 6/1988 Tong ..... 313/402
4,971,590 A * 11/1990 Tong ..... 445/47
5,164,021 A 11/1992 Kato et al. ..... 148/621
5,643,697 A 7/1997 Baudry et al. ..... 430/5
5,716,252 A 2/1998 Van Den Berg et al. ..... 445/47

FOREIGN PATENT DOCUMENTS

EP 0 251 821 1/1988
EP 0 280 512 8/1988
JP 1025944 A * 1/1989 ..... H01J/29/07
JP 08111184 4/1996

* cited by examiner

*Primary Examiner*—Michael H. Day
*Assistant Examiner*—Karabi Guharay
(74) *Attorney, Agent, or Firm*—Sughrue Mion, PLLC

(57) ABSTRACT

A stretched mask for a color picture tube and a material for the stretched mask. The stretched mask is formed from a nickel-iron alloy steel sheet made of a nickel-iron alloy containing 35.0% to 37.0% by weight of nickel and 0.01% to 0.06% by weight of carbon. The nickel-iron alloy steel sheet is provided with apertures by etching using a pattern provided on the sheet. The stretched mask is free from image degradation due to a rise in temperature.

4 Claims, 1 Drawing Sheet

Figure
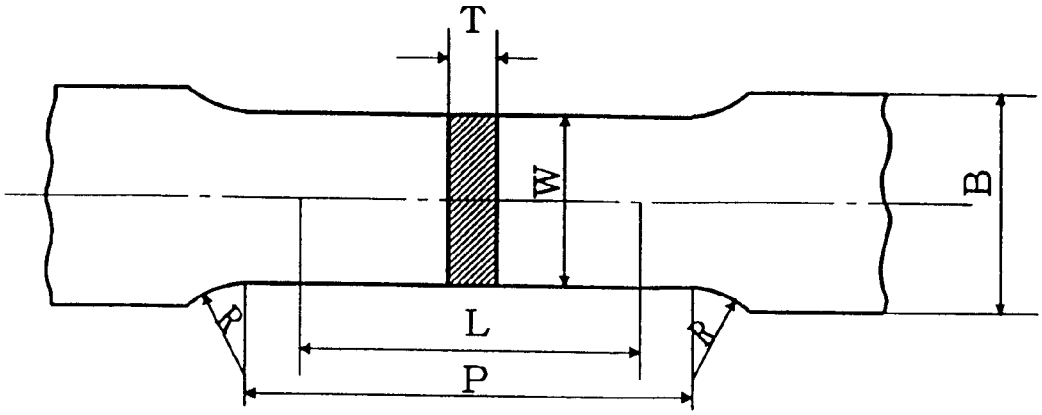

STRETCHED MASK FOR COLOR PICTURE TUBE

BACKGROUND OF THE INVENTION

The present invention relates to a stretched mask for a color picture tube, which can be used for any type of color picture tube, e.g. a shadow mask tube or an aperture grille tube, in color television and computer color displays.

In color picture tubes for color television and color displays, a mask for color selection is used so that electron beams are applied to predetermined phosphors. As the color selection mask, a shadow mask formed from a metal sheet provided with a large number of small holes or an aperture grille provided with a large number of slits is used. When a color picture tube is used continuously for a long period of time, the shadow mask or the aperture grille is heated because accelerated electrons collide against it, and distorted by thermal expansion. This may cause the electron beams to be gradually displaced relative to the phosphor screen, resulting in color shift in the colored image.

As a color selection mask for a color picture tube, a stretched color discrimination mask like an aperture grille, which is stretched on a firm frame, is used as well as a member pressed like a shadow mask.

The stretched color discrimination mask is formed as follows. A hot-rolled low-carbon steel strip containing carbon in units of 0.0001% is cold-rolled to a sheet having a thickness of 0.02 mm to 0.30 mm. After a large number of grid elements have been formed in the steel sheet by etching, the steel sheet is welded to a frame placed under pressure applied in a direction reverse to the stretching direction. Then, the pressure is removed to form tension by the restoring force of the frame. Thereafter, to prevent the generation of secondary electrons, heat radiation, formation of rust, etc., the mask stock is subjected to heat treatment for 10 to 20 minutes in an oxidizing atmosphere at 450° C. to 470° C., thereby blackening the surface of the mask.

In a color picture tube, the temperature of the color discrimination mask is raised by irradiation with electron beams. However, the color discrimination mask reaches approximately thermal equilibrium about 2 hours after starting energization. In the case of a color discrimination mask made of a low-carbon steel sheet, thermal expansion occurs to a considerable extent as the temperature rises. Therefore, the color discrimination mask needs to be stretched under high tension so that the stretched color discrimination member will not slacken during use. For stretching under high tension, a member of high strength is needed, and a frame for mounting the stretched mask also needs high strength.

Under these circumstances, a method has been conceived in which deformation or the like due to the rise in temperature is prevented by using a metallic material having a low coefficient of thermal expansion. However, an Invar material consisting of a nickel-iron alloy, which is a typical metallic material of low thermal expansion used for shadow masks of color picture tubes, has no sufficiently high strength and is therefore incapable of providing a sheet that endures a tension required for stretching. Accordingly, it is impossible to obtain a satisfactory sheet stock for producing a stretched color discrimination mask.

Meanwhile, the stretched color discrimination member needs to reduce the thickness of the metallic material in comparison to a color discrimination member press-formed in conformity to the curved surface of a color picture tube. Therefore, the color discrimination member made of a low-carbon steel sheet cannot provide a satisfactory magnetic shielding effect.

An object of the present invention is to provide a stretched color selection device for a color picture tube that has a high magnetic shielding effect and a low coefficient of thermal expansion and hence allows the stretching tension to be reduced.

BRIEF DESCRIPTION OF THE DRAWINGS

The FIGURE is a digram illustrating the configuration of a test piece used in a tensile test on the stretched mask for a color picture tube according to the present invention.

SUMMARY OF THE INVENTION

The present invention provides a stretched mask for a color picture tube. The stretched mask is formed from a nickel-iron alloy steel sheet made of a nickel-iron alloy containing 35.0% to 37.0% by weight of nickel and 0.01% to 0.06% by weight of carbon. The nickel-iron alloy steel sheet is provided with apertures by etching using a pattern provided on the nickel-iron alloy steel sheet.

In the stretched mask, the nickel-iron alloy steel sheet contains, on a weight basis, 35.0% to 37.0% of nickel, 0.01% to 0.06% of carbon, not more than 0.30% of silicon, 0.10% to 0.60% of manganese, not more than 0.020% of phosphorus, not more than 0.020% of sulfur, and incidental impurities as components other than iron.

In addition, the present invention provides a material for producing a stretched mask for a color picture tube. The material consists essentially of a nickel-iron alloy containing 35.0% to 37.0% by weight of nickel and 0.01% to 0.06% by weight of carbon.

DESCRIPTION OF THE PREFERRED EMBODIMENT

The present invention is based on the finding that it is possible to obtain a stretched mask having a low coefficient of thermal expansion and exhibiting a sufficiently high strength even when the thickness is reduced, by using a nickel-iron alloy having a specific alloy composition in place of the conventional low-carbon steel.

More specifically, the stretched mask according to the present invention is formed by using a nickel-iron alloy, e.g. an Invar alloy, which is known as a low-expansion alloy. The nickel-iron alloy has a carbon content increased to a level of 0.01% to 0.06% by weight to thereby obtain a stretched mask having high strength and providing a satisfactory magnetic shielding effect even when the thickness is reduced.

In addition, because the stretched mask according to the present invention uses a low-expansion alloy of high strength in comparison to the low-carbon steel, the initial tension can be reduced.

In the stretched mask according to the present invention, the nickel content is preferably in the range of from 35.0% to 37.0% by weight. If the nickel content is not within this range, the coefficient of thermal expansion increases unfavorably.

It is necessary for the stretched mask according to the present invention to contain a specific amount of carbon in order to increase the strength. A carbon content less than 0.01% by weight makes it impossible to obtain sufficiently high strength. A carbon content more than 0.06% by weight impairs the etching properties and causes the amount of carbide inclusions to increase unfavorably.

Silicon forms silicate inclusions such as MnO—$SiO_2$ and MnO—FeO—$SiO_2$ and consequently impairs the etching properties. Therefore, the silicon content is preferably not more than 0.30%.

The manganese content is preferably in the range of from 0.10% to 0.60% from the viewpoint of the deoxidizing action and hot shortness prevention in the steel making process.

If the phosphorus content increases, the steel hardens, and the rollability of the steel degrades. Therefore, the phosphorus content is preferably not more than 0.020%.

Sulfur forms sulfide inclusions and consequently impairs the etching properties. Therefore, the sulfur content is preferably not more than 0.020%.

The present invention will be described below by way of examples.

EXAMPLE 1

A nickel-iron alloy sheet stock of 0.1 mm in thickness made of material A, whose chemical composition (% by weight) is shown in Table 1 below, was coated at both sides thereof with a water-soluble casein resist. After drying, the resists on the two sides of the sheet stock were patterned in the shape of slits by using a pair of glass dryplates having obverse and reverse patterns drawn thereon, respectively.

Next, exposure, hardening and baking processes were carried out. Thereafter, the patterned resist surfaces were sprayed with a ferric chloride solution having a temperature of 60° C. and a specific gravity of 48° Be (Baume degree for heavy liquid) as an etching liquid by using a spray to perform etching.

After the etching process, rinsing was carried out, and the resist was removed with an alkaline aqueous solution, followed by washing and drying to produce a color discrimination mask.

Each color discrimination mask thus obtained was evaluated by the following evaluation method. The results of the evaluation are shown in Table 2 below. In Table 2, the transmittance is the ratio (expressed as percent) of the aperture area to the area of a region lying between the apertures at both ends.

TABLE 1

| | C | Si | Mn | P | S | Ni | Balance |
|---|---|---|---|---|---|---|---|
| Material A | 0.051 | 0.01 | 0.25 | 0.0006 | 0.008 | 36.5 | Fe and incidental impurities |

Evaluation Method

1. Uniformity

After the aperture diameter had been adjusted so that the transmittance was the same as that of the mask, a visual check was made as to whether or not there were variations in the aperture diameter. Furthermore, variations in diameter of 25 neighboring apertures were measured. When the variation value was 0.80 $\mu$m or more, the aperture diameter uniformity was judged to be bad.

2. Tensile strength

The tensile strength was measured by the tensile testing method defmed by ISO 6892 (JIS Z2241) using a test piece shown in the FIGURE.

In the FIGURE, the length of each portion is as follows:

L (gauge length): 50 mm

P (parallel length): 60 mm

R (radius of fillet): 20 mm

T (thickness): thickness of material

B (gripped ends): 30 mm

3. Coercive force Hc

After the original sheet had been blackened by heat treatment in the atmosphere at 670° C. for 30 minutes, the coercive force was measured according to the coercive force measuring method defined by JIS C2531 (iron-nickel magnetic alloy sheets and strips). That is, the magnetic field strength at which the magnetic flux density in the material became zero, when an external magnetic field 1000 A/m applied to the material was removed and the material was magnetized in opposite direction, was measured in the unit of A/m (ampere per meter).

Comparative Example 1

A nickel-iron alloy sheet of 0.1 mm in thickness having a composition consisting essentially of, by weight ratio, 0.003% of C, 0.01% of Si, 0.25% of Mn, 0.006% of P, 0.008% of S, 36.0% of Ni, and the balance Fe and incidental impurities was etched in the same way as in Example 1 to produce a color discrimination mask. The color discrimination mask was evaluated in the same way as in Example 1. The results of the evaluation are shown in Table 2.

Comparative Example 2

A nickel-iron alloy sheet of 0.1 mm in thickness having a composition consisting essentially of, by weight ratio, 0.002% of C, 0.01% of Si, 0.20% of Mn, 0.015% of P, 0.007% of S, and the balance Fe and incidental impurities was etched in the same way as in Example 1 to produce a color discrimination mask. The color discrimination mask was evaluated in the same way as in Example 1. The results of the evaluation are shown in Table 2.

TABLE 2

| | Transmittance (%) | Aperture diameter variation (μm) | Uniformity | Tensile strength (N/mm$^2$) | Coefficient of thermal expansion (× $10^{-7}$/° C.) | Recrystallization temperature (° C.) | Coercive force Hc (A/m) |
|---|---|---|---|---|---|---|---|
| Example 1 | | | | | | | |
| material A | 19.0 | 0.55 | good | 850 | 2.4 | 750 | 90 |
| Comp. Ex. 1 | 18.9 | 0.53 | good | 616 | 1.2 | 700 | 64 |
| Comp. Ex. 2 | 19.0 | 0.56 | good | 950 | 12.5 | 550 | 130 |

The stretched mask for a color picture tube according to the present invention has high strength in comparison to the conventional low-expansion nickel-iron alloy mask and is therefore capable of being stretched in the form of a nickel-iron alloy steel sheet. In addition, because the stretched mask has a low coefficient of thermal expansion, the initial tension applied to the mask when stretched can be reduced. Even when the nickel-iron alloy material is formed into a sheet, it provides a high magnetic shielding effect, and thus high image display quality is obtained. Furthermore, the nickel-iron alloy steel sheet has a high recrystallization temperature in comparison to the low-carbon steel sheet. Therefore, the blackening temperature can be raised. Accordingly, it is possible to form a blackened film having higher corrosion resistance than in the case of a low-carbon steel sheet.

What we claim is:

1. A stretched mask for a color picture tube, said stretched mask comprising a nickel-iron alloy steel sheet made of a nickel-iron alloy containing 35.0% to 37.0% by weight of nickel, manganese in a content of greater than 0.1 wt % and less than 0.6 wt %, and 0.03% to 0.06% by weight of carbon, said nickel-iron alloy steel sheet being provided with apertures by etching using a pattern provided on said nickel-iron alloy steel sheet.

2. A stretched mask according to claim 1, wherein said nickel-iron alloy steel sheet contains, on a weight basis, 35.0% to 37.0% nickel, 0.03% to 0.06% of carbon, not more than 0.30% of silicon, manganese in a content of greater than 0.1% and less than 0.6%, not more than 0.020% of phosphorus, not more than 0.020% of sulfur, and incidental impurities as components other than iron.

3. A stretched mask according to claim 1, wherein said nickel-iron alloy steel sheet contains, on a weight basis, 35.0% to 37.0% nickel, 0.03% to 0.06% of carbon, not more than 0.30% of silicon, 0.25% to 0.60% of manganese, not more than 0.020% of phosphorus, not more than 0.020% of sulfur, and incidental impurities as components other than iron.

4. A stretched mask for a color picture tube, said stretched mask comprising a nickel-iron alloy steel sheet made of a nickel-iron alloy containing 35.0% to 37.0% by weight of nickel, 0.25% to 0.60% by weight of manganese, and 0.03% to 0.06% by weight of carbon, said nickel-iron alloy steel sheet being provided with apertures by etching using a pattern provided on said nickel-iron alloy steel sheet.

* * * * *